United States Patent [19]

Basterfield

[11] 4,163,293

[45] Aug. 7, 1979

[54] FLUSHING CISTERN

[76] Inventor: Ernest P. Basterfield, 22 High Rd., Eastleigh, Edenvale, Transvaal, South Africa

[21] Appl. No.: 839,364

[22] Filed: Oct. 4, 1977

[51] Int. Cl.[2] ..... A47K 4/00

[52] U.S. Cl. ..... 4/3; 4/1

[58] Field of Search ..... 4/1, 2, 3, 67 R, 67 A, 4/18 A, 57 P, 57 R, 34

[56] References Cited

U.S. PATENT DOCUMENTS

| | | | |
|---|---|---|---|
| 1,808,294 | 6/1931 | Crane | 4/3 |
| 1,868,760 | 7/1932 | Norberg | 4/3 |
| 1,935,779 | 11/1933 | Kemach | 4/3 |
| 3,015,827 | 1/1962 | Iwata | 4/3 X |
| 3,428,964 | 2/1969 | Lucas | 4/3 |
| 3,588,922 | 6/1971 | Carfora | 4/3 |
| 3,696,448 | 10/1972 | Carfora | 4/3 |
| 4,030,144 | 6/1977 | Aleman | 4/3 |

*Primary Examiner*—Henry K. Artis

*Attorney, Agent, or Firm*—Young & Thompson

[57] ABSTRACT

In a water-flushed toilet having a cistern, a fraction of the water inflowing to the cistern is bypassed to a basin, from which it is drained away through a vent. The basin is provided in the lid of a low-level cistern, or in a shelf in the case of a high-level cistern. The bypass consists of a pipe in the inlet to the cistern, feeding through a gooseneck pipe into the basin.

3 Claims, 3 Drawing Figures

FLUSHING CISTERN

BACKGROUND OF THE INVENTION

This invention relates to cisterns for storing water to flush toilets which term includes urinals. The invention relates to both low- and high-level cisterns.

In very many toilets, no facility is provided for hand-washing, and the object of the present invention is to provide such facility in new installations, or, without any substantial modifications of the cistern and its associated mechanism, in existing installations.

SUMMARY OF THE INVENTION

According to the invention, a fraction of the water flowing to the cistern from the inlet valve is bypassed to a basin, from which it is drained away through a vent.

In one form of the invention, the basin is a depression in the lid of a low-level cistern, and the basin is drained into the cistern. In another form, suitable for use with a high-level system, the basin is a separate element and drains into the toilet pan or urinal.

Also according to the invention, the bypassed water is fed to a gooseneck pipe which discharges into the basin.

DESCRIPTION OF THE DRAWINGS

Two embodiments of the invention are seen in the accompanying drawings, in which.

DESCRIPTION OF THE PREFERRED EMBODIMENTS

Figure 1:
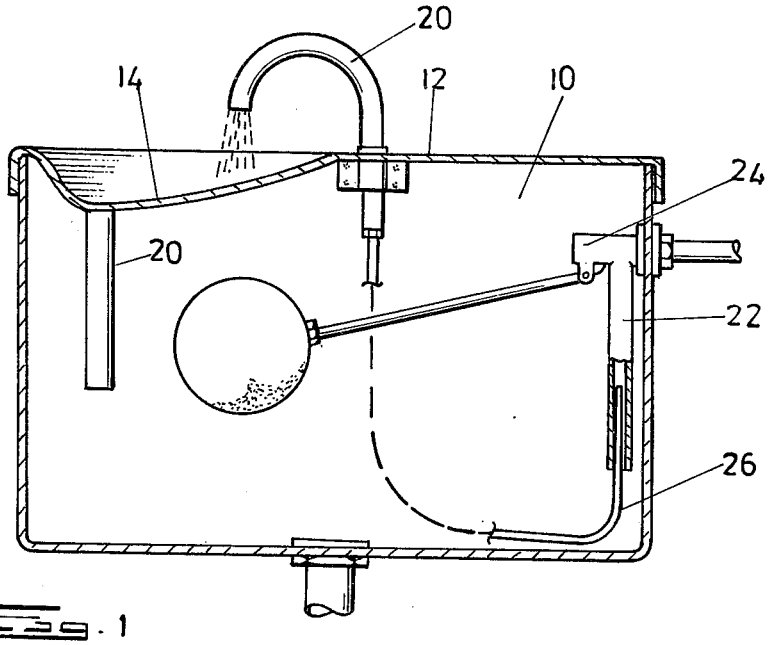
FIG. 1 is a vertical section through a low-level cistern.
Figure 3:
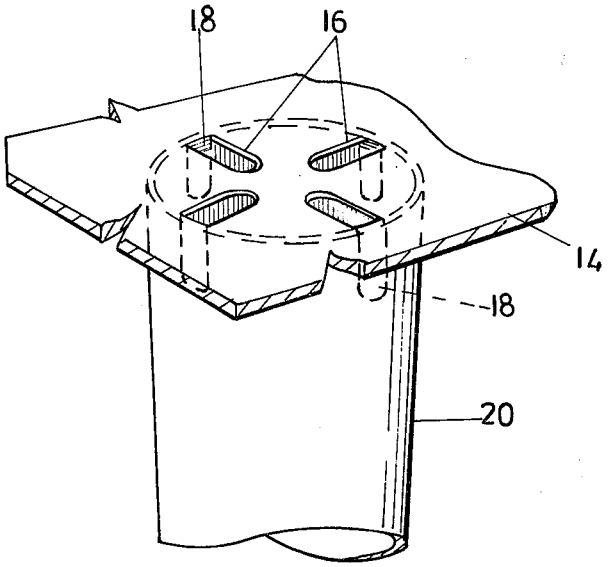
FIG. 3 is a detail of the drainage venting.

In FIG. 1, the normal float-controlled cistern 10 is provided with a lid 12 that differs from the norm in that it is formed with a depression 14 constituting a basin. The floor of the basin slopes to one corner, where holes 16 are provided for water in the basin to drain away into the cistern. The holes 16 are conveniently made by pressing four tongues 18 (FIG. 3) into the floor of the basin and bending them downwardly to engage the upper end of a drainage pipe 20 which extends downwardly into the cistern.

The normal downpipe 22 in the cistern through which water emerging from the inlet valve 24 flows into the cistern, has a pipe 26 inserted into it from its lower end. The pipe is smaller in outer diameter than the internal diameter of the downpipe 22, so that only a fraction of the water flowing into the downpipe enters the pipe 26.

The pipe 26 is curved upwardly, through the lid 12 of the cistern, and terminates in a gooseneck 28 above the basin 14.

The diameter of the pipe 26 and that of the downpipe 22 are such that sufficient water is fed into the pipe 26 to flow through the pipe and cause a flow of water through the pipe 28 sufficient to allow the hands to be rinsed. The aggregate drainage area of the holes 16 is sufficient to drain away the flow from the pipe 28 without causing the basin to overflow. And, of course, the basin is located to collect the splash.

Figure 2:
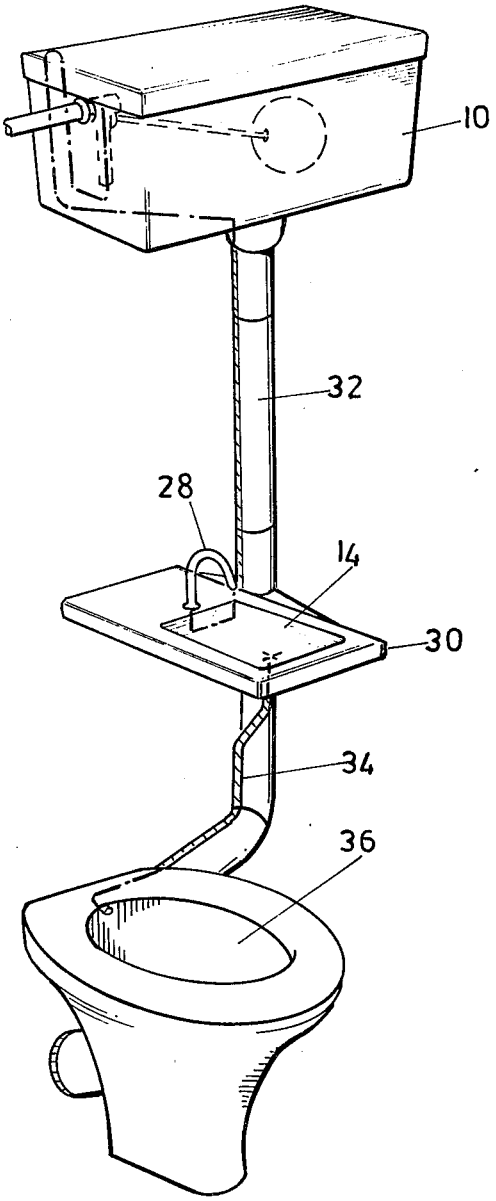
FIG. 2 is a perspective view of a high-level system incorporating the invention.

In FIG. 2 the pipe 26 is bent upwardly out of the cistern 10 and then downwardly to end in a gooseneck 28 above a basin 14 formed in a shelf 30 clamped to the downpipe 32 of the system. The floor of the basin is sloped downwardly, as in FIG. 1, to drainage holes that communicate with a pipe 34 that drains water into the pan 36 (or into the urinal, as the case may be).

I claim:

1. A flushing toilet comprising: a cistern, a lid on the cistern, a valve controlled inlet means to flow water into the cistern, including a downpipe in the cistern and through which water enters the cistern, an outlet from the cistern, and a pan to receive water from the outlet, characterised by a bypass pipe inserted into the downpipe, said bypass pipe being smaller in outside diameter than the inner diameter of the downpipe, an extension of the bypass pipe to conduct water from the bypass pipe and discharge it into the basin, and a vent in the basin for water to drain from it.

2. The toilet of claim 1 as applied to a high-level cistern or a urinal, characterised in that the basin is a shelf separate from the cistern.

3. The toilet of claim 2 including a standpipe into which the cistern discharges, characterised in that the shelf is mounted on the standpipe.

* * * * *